United States Patent [19]

Duffy

[11] Patent Number: 5,038,689

[45] Date of Patent: Aug. 13, 1991

[54] BOOK RESTRAINT ASSEMBLY FOR SHELVING

[76] Inventor: James C. Duffy, 9300 Dillion Drive, La Mesa, Calif. 92041

[21] Appl. No.: 626,850

[22] Filed: Dec. 13, 1990

[51] Int. Cl.[5] ..... A47F 5/13; A47B 9/00

[52] U.S. Cl. ..... 108/108; 211/42; 211/40; 211/183

[58] Field of Search ..... 108/108, 106, 107, 152; 211/42, 43, 183, 40, 41

[56] References Cited

U.S. PATENT DOCUMENTS

| | | | |
|---|---|---|---|
| 462,123 | 10/1891 | Friede | 211/88 X |
| 587,580 | 8/1897 | Hopkins et al. | 211/42 |
| 3,227,282 | 1/1966 | Punt | 211/41 X |
| 3,335,874 | 8/1967 | Levy et al. | 108/108 X |
| 3,556,306 | 1/1971 | Shell | 108/108 X |
| 3,701,325 | 10/1972 | Fenwick | 108/108 X |
| 4,072,230 | 2/1978 | Mulligan | 211/41 X |
| 4,711,419 | 12/1987 | Polosky | 211/42 |
| 4,867,318 | 9/1989 | Robson | 211/41 |

*Primary Examiner*—Peter A. Aschenbrenner

*Attorney, Agent, or Firm*—Charles C. Logan, II

[57] ABSTRACT

A book restraint assembly for shelving such as used in libraries. The book restraint assembly has a tubular restraint member that extends the length of the shelf assembly. End plates are positioned adjacent the opposite end of the tubular restraint member and each have a rivet that passes through an aperture therein with the shank of the rivet being received into the respective opposite ends of the tubular restraint member and secured therein. The rear ends of the end plates have a tab extending rearwardly and downwardly and these tabs are detachably received in the end tab slots of post members of a range library book shelf so that the end plates may be pivoted upwardly a predetermined height to allow the tubular restraint member to clear the height of any book on the shelf platform thus allowing them to be removed. An alternative embodiment of the book restraint assembly utilizes a cord member that passes through the tubular restraint member and the opposite ends of the cord member are attached to S-hooks that are detachably received in the end tab slots of the post members.

6 Claims, 1 Drawing Sheet

BOOK RESTRAINT ASSEMBLY FOR SHELVING

BACKGROUND OF THE INVENTION

The present invention relates to book shelves and more specifically to book shelves known as ranges such as are found in libraries.

Presently existing shelving in California schools is being upgraded, as funds become available, to meet Seismic Code requirements. All new shelving procured by California schools must met Seismic Code requirements. This will minimize the chance of shelving, that meets the code, for collapsing or tipping over during an earthquake.

An additional problem exists however, in that while the shelving may stay in place, the contents of the shelves can slide off the shelves during a quake and injure or kill patrons in a library. The books can be damaged if they fall off the shelves. Additionally, they must be placed back on the shelves if they have fallen off. Sorting and replacing books in their proper place on the shelves is a time consuming and expensive process.

Library administrators are concerned about this problem, but consider the restraint of books as too cumbersome and not practical, since it could interfere with free and easy removal of books from shelves and could cause damage to books being removed.

It is an object of the invention to provide a novel book restraint assembly that can be raised by a patron easily and quickly with one hand while the other hand removes a book from the shelf.

It is also an object of the invention to provide a novel book restraint assembly for shelving that can be easily and quickly installed.

It is another object of the invention to provide a novel book restraint assembly for shelving that is economical to manufacture and market.

It is an additional object of invention to provide a novel book restraint assembly for shelving that does not require modification of existing shelving.

SUMMARY OF THE INVENTION

The novel book restraint assembly for shelving does not require modification of existing shelving. Part of the structure of the book restraint assembly attaches to the exiting vertical post members of the shelving through existing end tab slots in the post members. These end tab slots run the length of the posts at one inch intervals. Therefore, no tools or special skills are required to install the structure just above each shelf. The height of the attachment points above each shelf can be adjusted in one inch increments to suit the average height of books being restrained. The book restraint assembly has no sharp edges or surfaces that could cause damage to the books being restrained.

The book restraint assembly has an elongated tubular restraint member having a length substantially equal to the length of the horizontal platform of a book shelf. The tubular restraint member in its preferred embodiment would be made of ½ inch diameter steel tubing. An end plate having an aperture adjacent its front end would have a rivet passing through the aperture and the rivet would be welded to the end plate. The shank of the rivet is received into the tubular restraint member and the shank has a flat side on it. A set screw is threaded into a threaded radial aperture in the tubular restraint member so that it contacts the flat side of the shank of the rivet to secure the respective parts together. The rear end of the end plates has an end tab extending rearwardly therefrom that makes an acute angle with the plane of the end plate itself. The end tabs are detachably received in the end tab slots of the post members. The structure thus provides adequate restraint to withstand a quake and the tubular restraint member can be raised by a patron easily and quickly with one hand while the other hand removes a book from the shelf. The tubular restraint member is then lowered to its original restraint position.

An alternative embodiment of the book restraint assembly for shelving uses a similar tubular restraint member. Instead of end plates it uses a #4 nylon cord member. The cord member passes through the tubular restraint member and it has loops formed on its opposite ends that are passed around a portion of a S-hook. The S-hooks would be easily insertable and removable from the existing end tab slots of the post members of the library ranges. This embodiment is primarily intended for use by staff members of a library and not the public; the drawbacks being, that the nylon cord could cause damage to books at the ends of the shelf if it is not properly used.

DESCRIPTION OF THE PREFERRED EMBODIMENT

Figure 3:
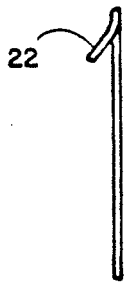
FIG. 3 is a front elevation view of one of the end panels.
Figure 2:
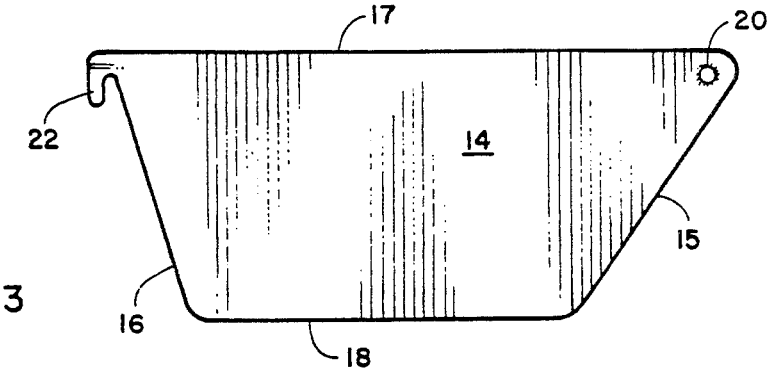
FIG. 2 is a left side elevational view of one of the end panels.
Figure 4:
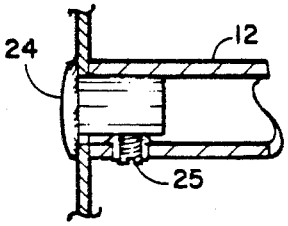
FIG. 4 is a cross sectional view illustrating how the tubular restraint member is secured to the end plates.
Figure 1:
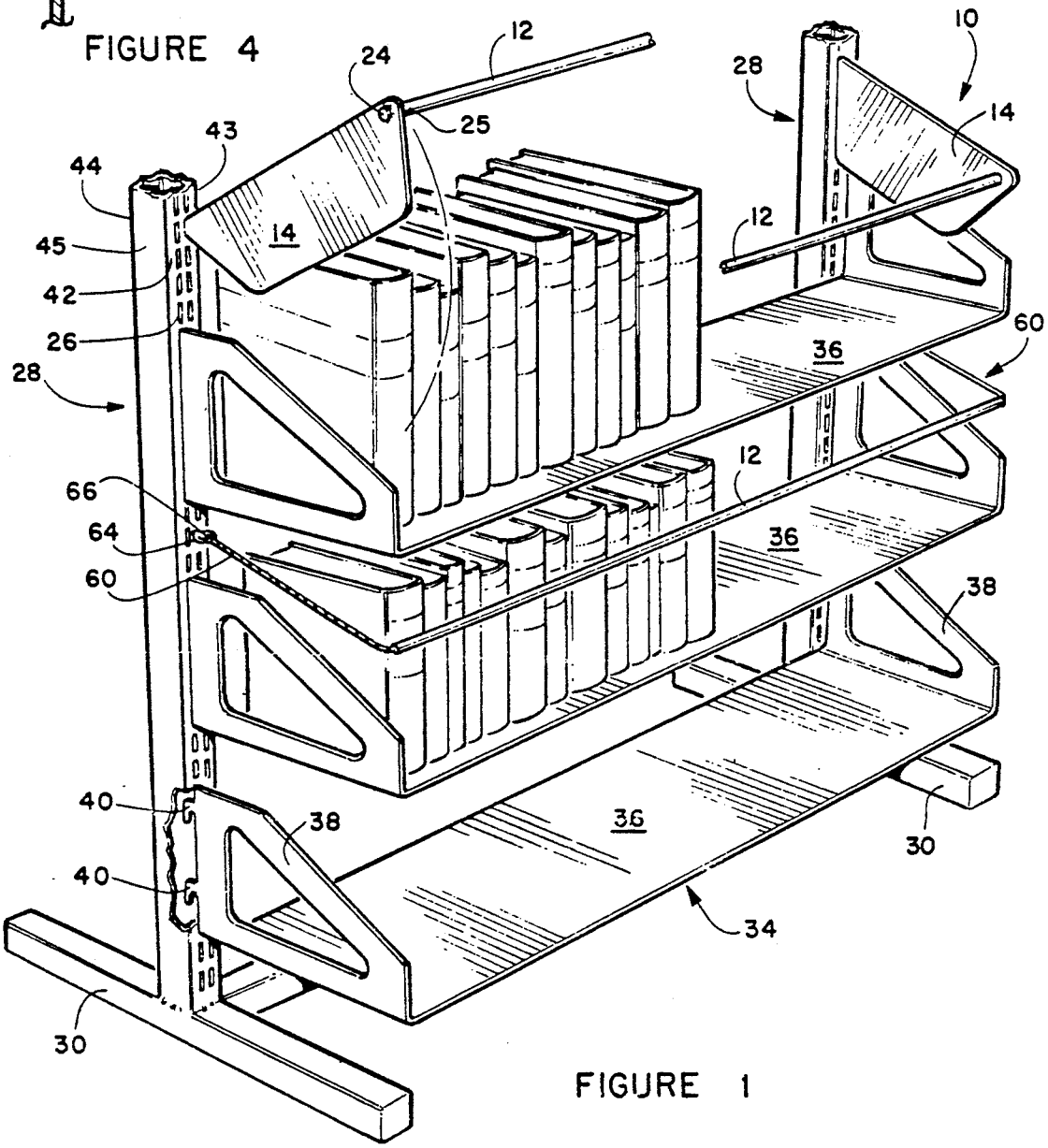
FIG. 1 is a front perspective view of two embodiments of a book restraint assembly that would be utilized with existing library ranges.

The novel book restraint assembly will now be described by referring to FIGS. 1–4 of drawing. The first version thereof is generally designated numeral 10.

Book restraint assembly 10 has an elongated tubular restraint member 12. End plates 14 have the general configuration of an inverted trapezoid. These end plates 14 have a front edge 15, a rear edge 16, a top edge 17 and a bottom edge 18. An aperture 20 is formed in the end plate adjacent its front end. An end tab 22 extends from rear edge 16 and it makes an acute angle with the planar surface of end plate 14. Rivets 24 pass through apertures 20 of the end plates and they are welded to the end plates. The shank of rivets 24 are received into the ends of tubular restraint member 12 and these shanks have a flat side on them. A set screw 25 is threaded into a threaded radial aperture in the tubular restraint member so that it contacts the flat side of the shank of the rivet to secure the respective parts together. End tabs 22 are detachably received in end tab slots 26 of the post members 28 of the library book ranges.

The library book ranges have elongated base members 30 for supporting the post members 28. A plurality of shelf assemblies 34 are detachably secured to the post members 28. The shelf assemblies 34 each have a horizontal platform 36 with ends walls 38 secured to its opposite ends. End wall members 38 have tab members 40 that are detactably received in end tabs slots 26. The post members 28 have a front wall 42, a right side wall 43, a rear wall 44 and a left side wall 45.

An alternative embodiment of the book restraint assembly is designated numeral 60. It has the same tubular restraint member 12. A cord member 60 has a loop 64 formed on its opposite ends. A S-hook 66 is passed through each of the loops 64 and the S-hooks are detachably secured in one of the end tabs slots 26 of post member 28.

What is claimed is:

1. A book restraint assembly in combination with a book shelf assembly comprising:

a pair of vertically oriented post members that are laterally spaced apart a predetermined distance, said post members each having a front wall, a right side wall and a left side wall, said front wall having a plurality of end tab slots spaced at predetermined vertical intervals;

at least one shelf assembly having a horizontal platform whose opposite ends are each attached to vertically oriented end wall members, said end wall members having a rear edge with a pair of tab members extending rearwardly therefrom, said tab members being removably engaged in the end tab slots of said post members; and a book restraint assembly having an elongated tubular restraint member having a left end, a right end and a predetermined length, a left end plate and a right end plate having means of detachably securing them to the respective left and right ends of said tubular restraint member, an end tab extending rearwardly from each of said end plates and they are detachably received in the end tab slots of said post members so that said end plates may be pivoted upwardly a predetermined height to allow the tubular restraint member to clear the height of any books on the shelf platform thus allowing them to be removed.

2. A book restraint assembly in combination with a hook shelf assembly as recited in claim 1 wherein said end plates each have a top edge, a bottom edge, a front edge and a rear edge; and said means for attaching the end plates to said tubular restraint member comprises an aperture in said end plate ajacent their front edge, a rivet for each end plate and they pass through said apertures and they are received into the respective ends of the said tubular restraint member.

3. A book restraint assembly in combination with a book shelf assembly as recited in claim 1 wherein said end plates have a configuration substantially similar to an inverted trapezoid.

4. A book restraint assembly in combination with a book shelf assembly as recited in claim 1 wherein said end tabs are attached to the planar surface of said end plates at an acute angle.

5. A book restraint assembly in combination with a book shelf assembly comprising:

a pair of vertically oriented post members that are laterally spaced apart a predetermined distance, said post members each having a front wall, a right side wall and a left side wall, said front wall having a plurality of end tab slots spaced at predetermined vertical intervals;

at least one shelf assembly having a horizontal platform whose opposite ends are each attached to vertically oriented end wall members, said end wall members having a rear edge with a pair of tab members extending rearwardly therefrom, said tab members being removably engaged in the end tab slots of said post member; and a book restraint assembly having an elongated tubular restraint member having a left end, a right end and a predetermined length, an elongated core member having a predetermined length that passes through said elongated restraint member, means for detachably securing the respective opposite ends of said cord member to a pair of hooks, and said hooks are detachably received in the end tab slots of said post members so that said cord member may be pivoted upwardly a predetermined height to allow the tubular restraint member to clear the height of any books on the shelf platform thus allowing them to be removed.

6. A book restraint assembly in combination with a book shelf assembly as recited in claim 5 wherein said hooks have a configuration that is S-shaped.

* * * * *